US005782510A

United States Patent [19]

Gass

[11] Patent Number: 5,782,510

[45] Date of Patent: Jul. 21, 1998

[54] GLOVE BOX LATCH

[75] Inventor: Paul E. Gass, Mokena, Ill.

[73] Assignee: Illinois Tool Works Inc., Glenview, Ill.

[21] Appl. No.: 700,860

[22] Filed: Aug. 21, 1996

[51] Int. Cl.[6] ..... E05C 1/12

[52] U.S. Cl. ..... 292/165; 292/DIG. 41

[58] Field of Search ..... 292/163–165, 292/300, DIG. 31, 337, 169, 173, 340, DIG. 41, 164, DIG. 42

[56] References Cited

U.S. PATENT DOCUMENTS

| | | | |
|---|---|---|---|
| 1,721,345 | 7/1929 | Levinson | 292/165 |
| 2,029,199 | 1/1936 | Segar | 292/163 |
| 2,108,359 | 2/1938 | Accardi | 292/165 |
| 2,121,596 | 6/1938 | Hill | 292/165 |
| 3,782,139 | 1/1974 | Rubner | 292/169 |
| 4,911,487 | 3/1990 | Rachoki | 292/DIG. 31 |
| 5,129,693 | 7/1992 | Schmitt | 292/300 |
| 5,292,159 | 3/1994 | Sandhu | 292/173 |
| 5,413,391 | 5/1995 | Clavin | 292/DIG. 31 |
| 5,484,178 | 1/1996 | Sandhu | 292/173 |

FOREIGN PATENT DOCUMENTS

| | | | |
|---|---|---|---|
| 1570589 | 5/1969 | France | 292/163 |

*Primary Examiner*—Steven N. Meyers
*Assistant Examiner*—Gary Estremsky
*Attorney, Agent, or Firm*—Kane, Dalsimer, Sullivan, Kurucz, Levy, Eisele and Richard, LLP

[57] ABSTRACT

A latch assembly for a glove box or similar compartment in a motor vehicle has a receptacle in which a slide is biased from an unlocked position toward a locked position. The receptacle has two side walls and, at the locked position of the slide, a notch in each side wall. The notches, together with the slide when it is in the locked position, define an enclosed passage for a striker to which the latch assembly is designed to be locked.

6 Claims, 3 Drawing Sheets

GLOVE BOX LATCH

BACKGROUND OF THE INVENTION

1. Field of the Invention

The present invention is a latch assembly, and, more particularly, is a latch assembly for a glove box or compartment in a motor vehicle wherein a handle for opening same is flush with its door.

2. Background of the Invention

Latch assemblies of the subject type are old in the art. Generally, the handle is in a recess in the door of the glove box so as to offer a pleasing appearance thereto, as well as to reduce the number of possible physical obstructions on the dashboard or center console. Pulling the handle results in the substantially rotational motion thereof being transferred to a mechanical link which transforms the rotational motion to a linear motion to retract the bolt.

Latch assemblies for glove compartments and other storage boxes in motor vehicle interiors must be able to pass various front impact collision tests by remaining closed after delivery of an impact. Many designs currently in use do not pass these stringent tests. The present invention is intended to provide an alternative not susceptible to failure when subjected to these tests.

SUMMARY OF THE INVENTION

Accordingly, the present invention is a latch assembly for a glove box or similar compartment in a motor vehicle.

The latch assembly includes a slide which is translatable from a locked position to an unlocked position in a receptacle in a housing. The receptacle has a pair of side walls which, at the locked position of the slide, each have a notch. The notches and the slide together define a passage for accommodating a striker to which the latch assembly is designed to be locked.

The latch assembly also includes means for biasing the slide from the unlocked position toward the locked position.

The latch assembly further includes a handle rotatably attached to the housing and having a member operatively engaging the slide so that, when the handle is pulled by an operator, causing it to rotate with respect to the housing, the member moves the slide from the locked position to the unlocked position.

The present invention will now be described in more complete detail, with frequent reference being made to the following set of drawing figures.

DETAILED DESCRIPTION OF THE PREFERRED EMBODIMENTS

Figure 1:
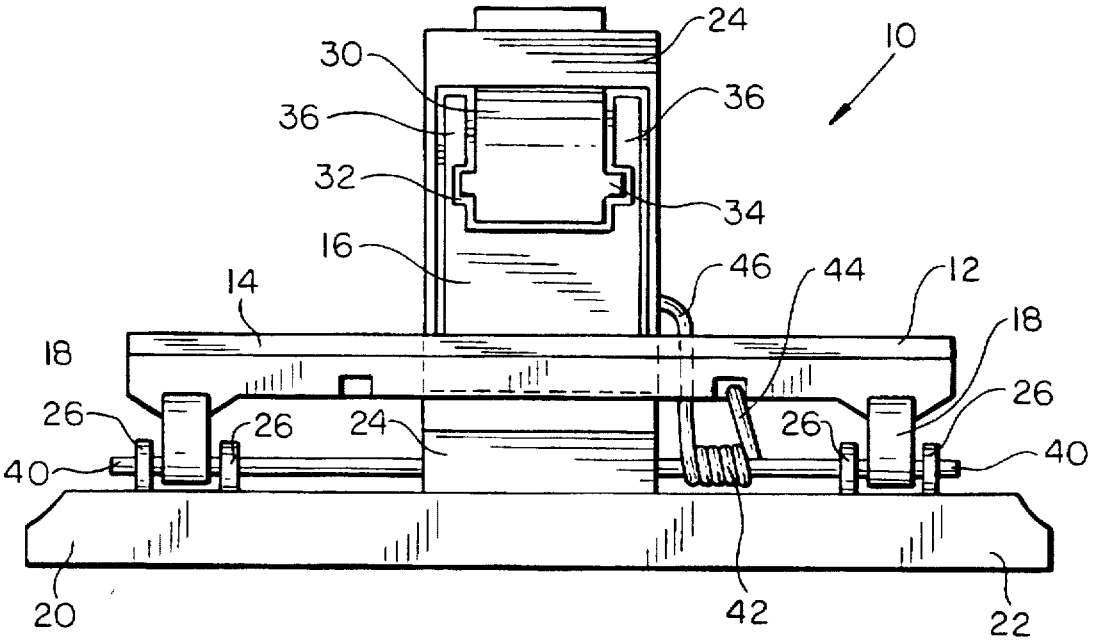
FIG. 1 is a front view of the latch assembly of the present invention.

FIG. 1 is a front view of the latch assembly 10 of the present invention. The latch assembly 10 comprises a housing 12 including a mounting plate 14 and a receptacle 16 attached or joined to one side thereof. Attached or joined to the other side of the mounting plate 14 are hinge members 18 for attaching handle 20 thereto. The entire housing 12, including mounting plate 14, receptacle 16 and hinge members 18, may be integrally molded from a polymeric resin (plastic) material.

Handle 20 comprises a lift plate 22 and a rectangular extension 24 attached or joined to one side thereof. Rectangular extension 24 has a rectangular opening which allows it to extend around receptacle 16 on housing 12. Attached to that same side of the handle 20 are hinge members 26 for attaching handle 20 to housing 12. The entire handle 20, including lift plate 22, rectangular extension 24 and hinge members 26, may also be integrally molded from a polymeric resin (plastic) material.

Slide 30 is disposed in receptacle 16. Receptacle 16 is provided with channels 32, and slide 30 is provided with ribs 34, which ride in channels 32, so that slide 30 may be movable vertically within receptacle 16 while being maintained therein. Slide 30 may also be integrally molded from a polymeric resin (plastic) material.

Handle 20 is joined to housing 12 by pin 40, which passes through hinge members 18,26. A torsion spring 42, wound around pin 40, has a first extension 44 constrained against housing 12 and a second extension 46 constrained against the underside of rectangular extension 24, and biases handle 20 in a direction opposite to that in which it is pulled when the latch assembly 10 is being released.

Figure 2:
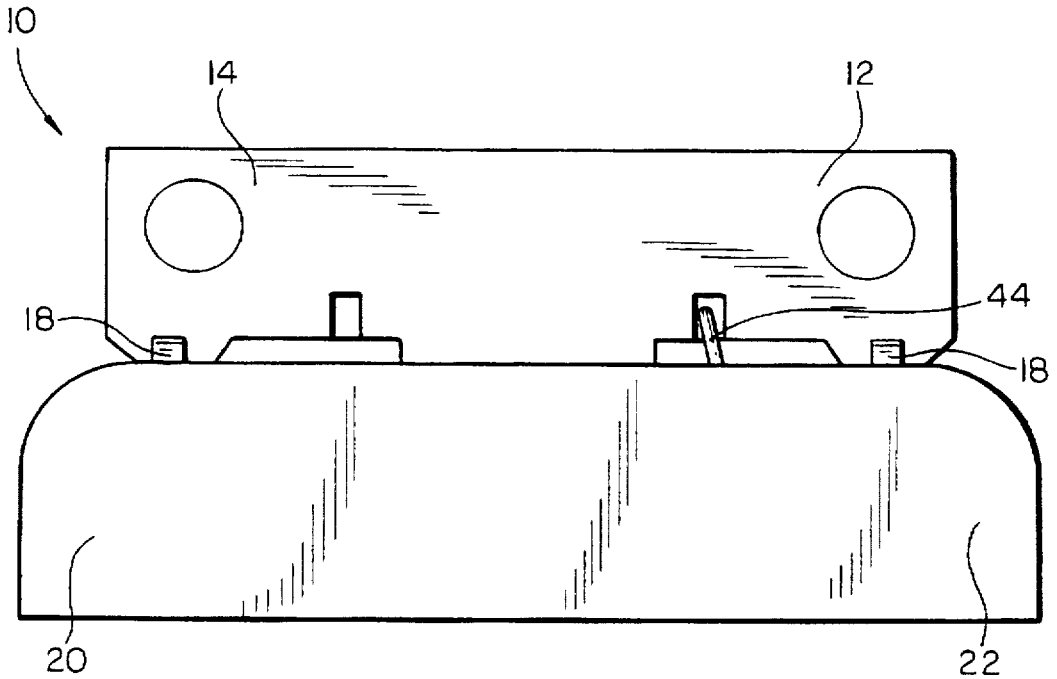
FIG. 2 is a top view thereof.

FIG. 2 is a top view of the latch assembly 10 of the present invention, showing its appearance to an observer viewing from below the view presented in FIG. 1. In a like manner, FIG. 3 is a side view of the latch assembly 10, showing its appearance to an observer viewing from the right of that presented in FIG. 1.

Figure 3:
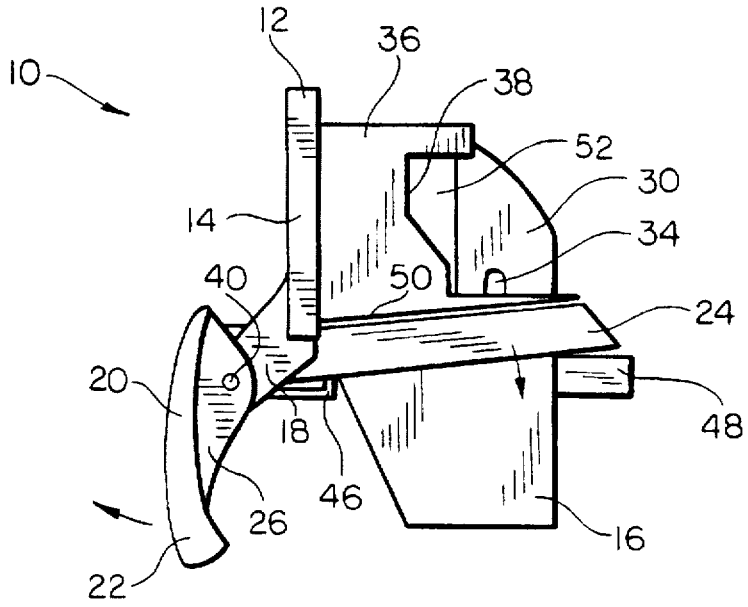
FIG. 3 is a side view thereof.

Referring specifically to FIG. 3, latch assembly 10 is opened by pulling lift plate 22 of handle 20 in the direction of the arrow. The rotation of lift plate 22 about pin 40 is accompanied by a like rotation of rectangular extension 24 about pin 40. Rectangular extension 24 thereby lowers slide 30 by acting upon shelf 48 which is an integral part thereof. Second extension 46 of torsion spring 42 biases handle 20, including lift plate 22 and rectangular extension 24, in a direction opposite to that in which it rotates in FIG. 3, to help restore the latch assembly 10 to the configuration shown in FIG. 3 when lift plate 22 is released.

Slide 30 is upwardly biased by a compression spring not shown in FIG. 3. When lift plate 22 is released, this compression spring moves the slide 30 upward. Shelf 48, acting upon rectangular extension 24, assists torsion spring 42 in restoring latch assembly 10 to the configuration shown in FIG. 3. Ledge 50 on receptacle 16 prevents rectangular extension 24 from rotating counterclockwise beyond the point shown.

When the latch assembly 10 is closed, as shown in FIG. 3, slide 30 and side walls 36, having notches 38, of receptacle 16 define a passage 52 in which a striker, not shown but part of a dashboard or other part of a vehicle interior, may be totally enclosed. In this manner, the striker is locked between the housing 12 and the slide 30 when the latch assembly 10 is closed therearound. This enable the present latching assembly 10 to pass various front impact collision tests more successfully than those heretofore available.

Figure 4:
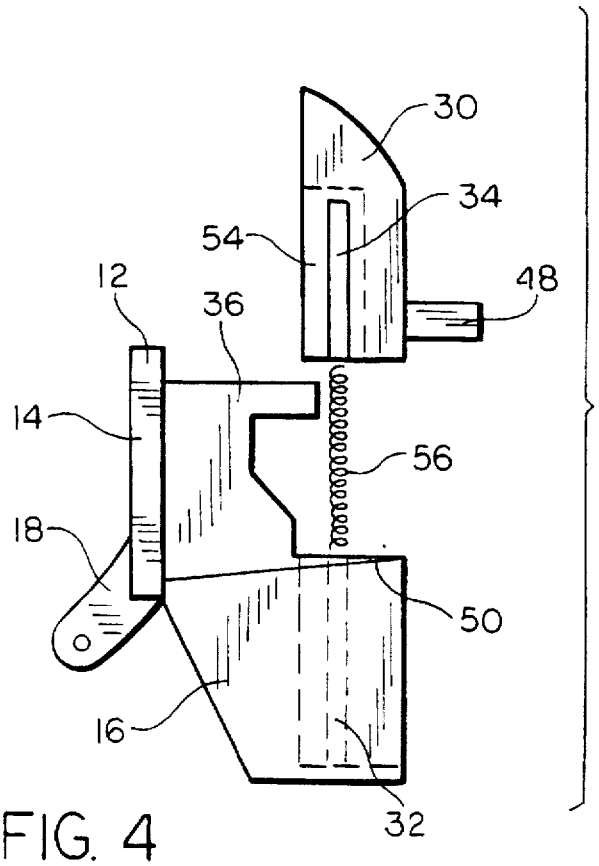
FIG. 4 is an exploded view showing the relationship among several of the elements shown in FIG. 3.

FIG. 4 is a side view, similar to that presented in FIG. 3 and showing the relationship between the slide 30 and the housing 12. Slide 30 has an internal spring pocket 54 for compression spring 56, which biases slide 30 upward in receptacle 16. Ribs 34 riding in channels 32 prevent slide 30 from moving laterally out of receptacle 16.

Figure 5:
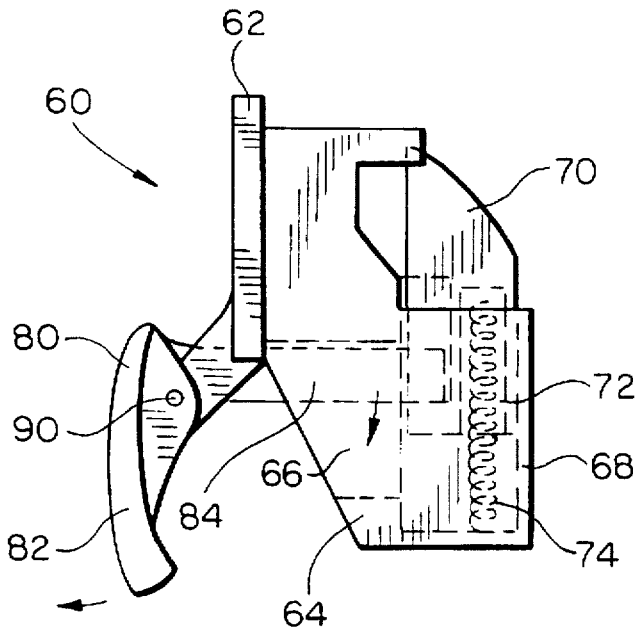
FIG. 5 is a side view of an alternate embodiment of the latch assembly.

FIG. 5 is a side view of an alternate, and preferred, embodiment of the latch assembly 60 of the present invention. In this preferred embodiment, housing 62 has a receptacle 64 for slide 70. Receptacle 64 has a passageway 66 opening outward toward handle 80, which comprises a lift plate 82 and an arm 84.

Figure 6:
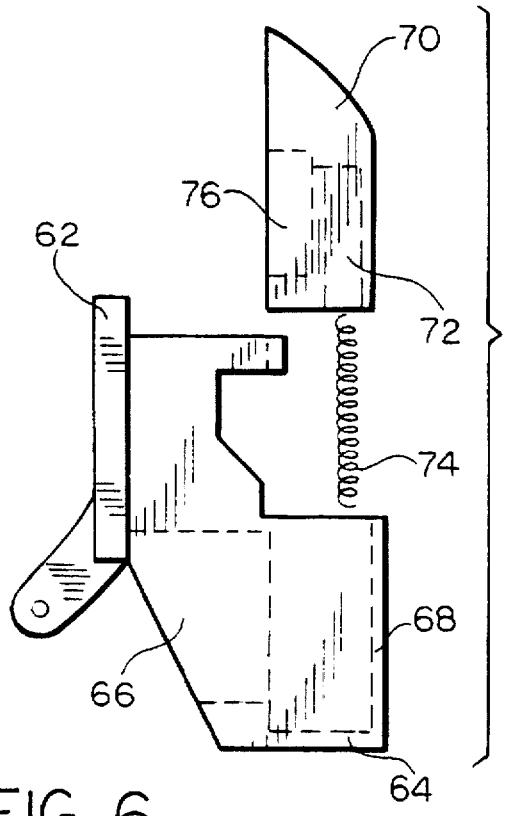
FIG. 6 is an exploded view showing the relationship among several of the elements shown in FIG. 5.

FIG. 6 is a side view, similar to that presented in FIG. 5 and showing the relationship between the slide 70 and the housing 62. Slide 70 has an internal spring pocket 72 for compression spring 74, which biases slide 70 upward in receptacle 64. Receptacle 64 has a front wall 68 which prevents slide 70 from moving laterally out of receptacle 64. Slide 70 also has a side cavity 76, which faces passageway 66.

Referring back to FIG. 5, arm 84 of handle 80 passes through passageway 66 and into side cavity 76 of slide 70. Latch assembly 60 is opened by pulling lift plate 82 of handle 80 in the direction of the arrow. The rotation of lift plate 82 about pin 90 is accompanied by a like rotation of arm 84 about pin 90. Arm 84, pushing downward upon the bottom of side cavity 76, lowers slide 70 against the upward biasing force provided by compression spring 74. When handle 80 is released, compression spring 74 moves slide 70 upward until the bottom of side cavity 76 has moved arm 84 up to the top of passageway 66, restoring the latch assembly 60 to the configuration shown in FIG. 5. Compression spring 74, replacing torsion spring 42 and compression spring 56 of the embodiment shown in FIGS. 1 through 4, is the only spring included in this preferred embodiment. It will also be noted that the design of this preferred embodiment of the latch assembly 60 eliminates the need for torsion spring 42 and shelf 48. In other respects, latch assembly 60 is the same as latch assembly 10. Housing 62, slide 70 and handle 80 may be integrally molded from a polymeric resin (plastic) material. In both embodiments, compression springs 56, 74 and torsion spring(s) 42, if included, may be of stainless steel.

Modifications to the above would be obvious to those of ordinary skill in art, but would not bring the invention so modified beyond the scope of the appended claims.

What is claimed is:

1. A latch assembly for a glove box or similar compartment in a motor vehicle, said latch assembly comprising:

a slide;

a housing, said housing having a receptacle wherein said slide is disposed and is slidably translatable between a locked position and an unlocked position, said receptacle having a pair of side walls, each of said side walls having a notch at said locked position of said slide, a top of said slide extending above a bottom of a portion of each of said side walls above said notches when said slide is at said locked position, said notches, said side walls and said slide defining an enclosed passage at said locked position for accommodating a striker to which said locking assembly is to be locked;

means for biasing said slide from said unlocked position toward said locked position; and a handle, said handle being rotatably attached to said housing and having a member operatively engaging said slide so that when said handle is pulled by an operator, causing it to rotate with respect to said housing, said member moves said slide from said locked position to said unlocked position.

2. A latch assembly as claimed in claim 1 wherein said means for biasing said slide is a compression spring, and wherein said slide has an internal spring pocket wherein at least an end of said compression spring is disposed.

3. A latch assembly as claimed in claim 1 wherein said housing and said handle each have hinge elements, said hinge elements of said housing being connected to said hinge elements of said handle by a pin, so that said handle may be rotated relative to said housing.

4. A latch assembly as claimed in claim 3 further comprising a torsion spring, said torsion spring being disposed about said pin and having a first and a second extension, said first extension being constrained against said housing and said second extension being constrained against said member of said handle, so that said handle may be further biased in a direction opposite to that in which it is pulled to open said latch mechanism.

5. A latch mechanism as claimed in claim 1 wherein said slide has a shelf facing away from said handle and wherein said member of said handle is a rectangular extension surrounding said receptacle and operatively engaging said shelf, thereby moving said slide from said locked position to said unlocked position when said handle is pulled.

6. A latch mechanism as claimed in claim 1 wherein said slide has a side cavity facing toward said handle, wherein said receptacle has a passageway communicating with said side cavity, and wherein said member of said handle is an arm extending through said passageway to said side cavity, thereby moving said slide from said locked position to said unlocked position when said handle is pulled.

* * * * *